United States Patent [19]

Kajiwara et al.

[11] Patent Number: 4,565,774

[45] Date of Patent: Jan. 21, 1986

[54] METHOD FOR THE FORMATION OF DYE IMAGE

[75] Inventors: Makoto Kajiwara; Kaoru Onodera, both of Odawara, Japan

[73] Assignee: Konishiroku Photo Industry Co., Ltd., Tokyo, Japan

[21] Appl. No.: 662,264

[22] Filed: Oct. 18, 1984

Related U.S. Application Data

[63] Continuation of Ser. No. 443,237, Nov. 22, 1982, abandoned.

[30] Foreign Application Priority Data

Dec. 1, 1981 [JP] Japan ..... 55-193443

[51] Int. Cl.[4] ..... G03C 7/16

[52] U.S. Cl. ..... 430/382; 430/489; 430/544

[58] Field of Search ..... 430/382, 489, 544

[56] References Cited

U.S. PATENT DOCUMENTS

| | | | |
|---|---|---|---|
| 2,490,751 | 12/1949 | Hanson | 430/489 |
| 2,496,940 | 2/1950 | Hanson et al. | 430/489 |
| 3,935,014 | 1/1976 | Klotzer et al. | 430/567 |
| 4,063,951 | 12/1977 | Bogg | 430/567 |
| 4,067,739 | 1/1978 | Lewis | 430/567 |

*Primary Examiner*—J. Travis Brown

*Attorney, Agent, or Firm*—Jordan B. Bierman

[57] ABSTRACT

Method for forming a dye image comprising imagewise exposing and processing a silver halide light-sensitive color photographic material having a support and coated thereon a silver halide emulsion layer containing silver halide crystals, wherein said silver halide crystals consist essentially of crystals having at least 80 mole % of silver chloride, said developing taking place in a developer essentially free from bromide ion and having a pH value of at least 9.5, in the presence of a p-phenylenediamine color-developing agent and a compound of the formula having an acid dissociation constant of not more than $1\times10^{-8}$ and a solubility product with silver ion of not more than $1\times10^{-10}$, wherein Z, together with N forms a heterocyclic ring, said compound.

11 Claims, 4 Drawing Figures

FIG. 1 (1)
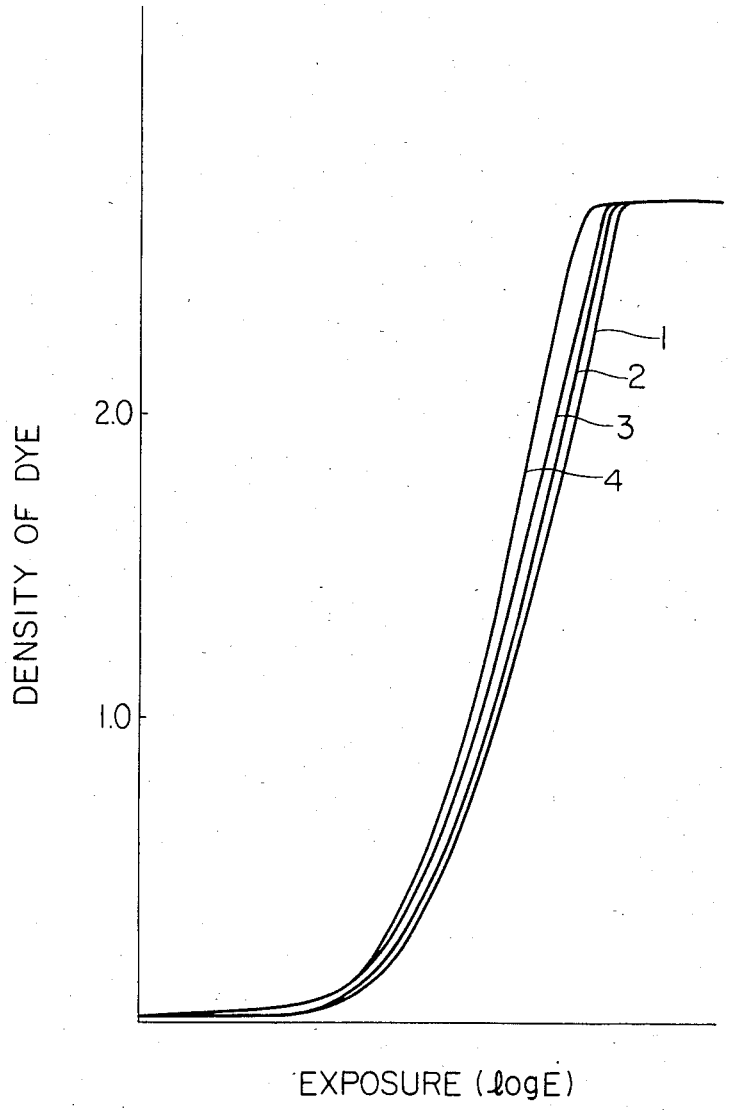

FIG. 1 (2)
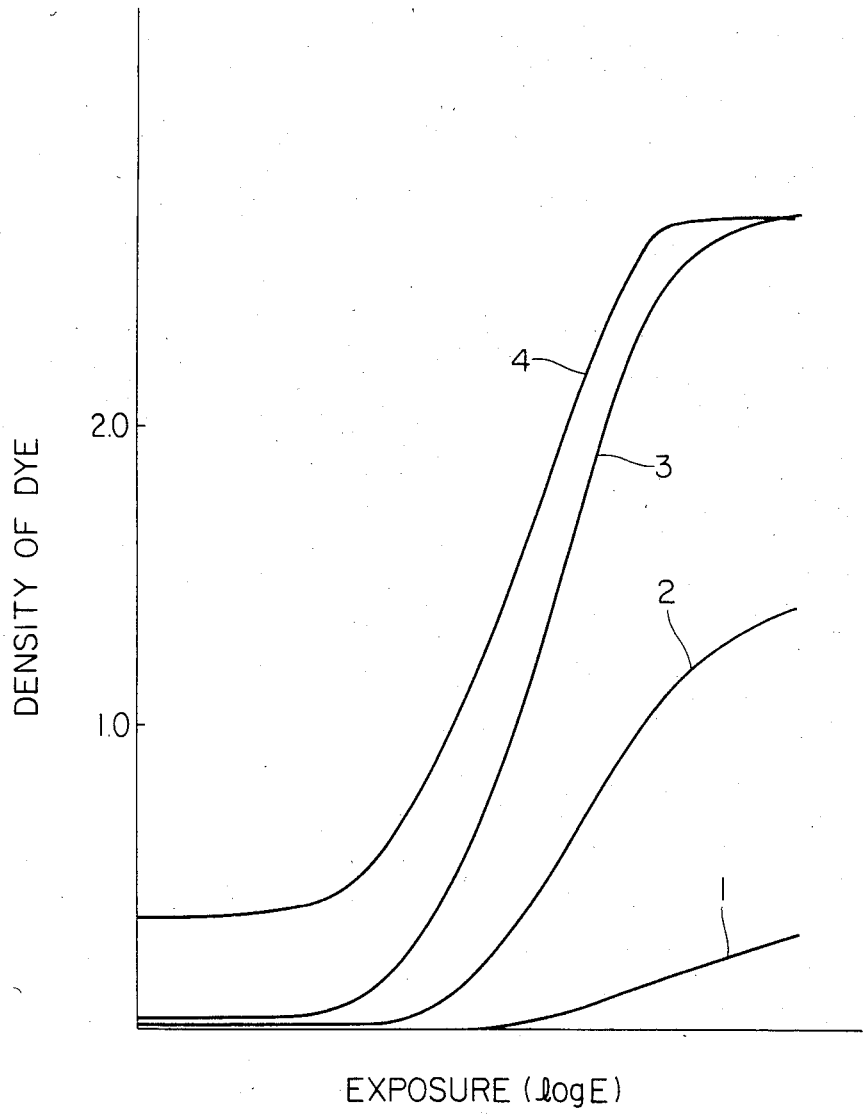

FIG. 1 (3)
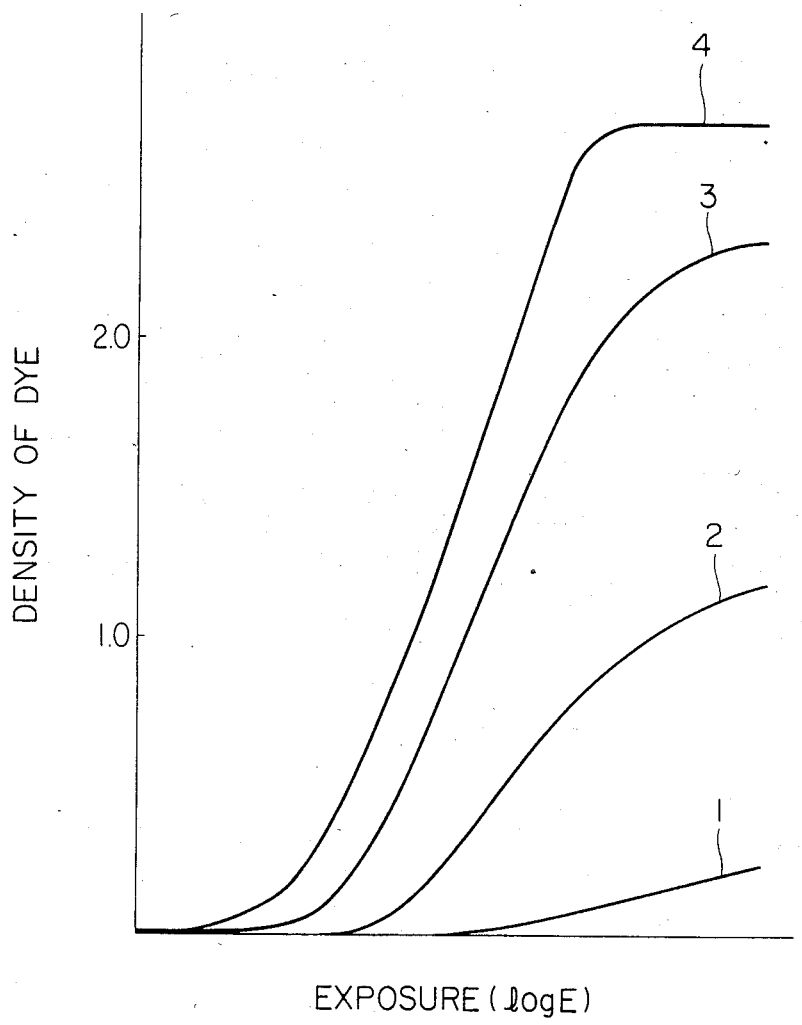

METHOD FOR THE FORMATION OF DYE IMAGE

This application is a continuation of Application Ser. No. 443,237, filed Nov. 22, 1982, now abandoned, which claims priority of Japanese Application No. 193443/1981, filed Dec. 1, 1981.

The present invention relates to a method for the formation of a dye image, and more particularly to a method which uses a high-chloride silver halide light-sensitive photographic material and which is excellent in the developability and capable of forming a satisfactorily color-reproducible dye image.

The words "high-chloride" silver halide" used herein means a silver halide that contains silver chloride in a quantity of not less than 80 mole%.

In the color developing process for a silver halide color light-sensitive photographic material, it is desirable to attain a rapid development and satisfactory maximum density (Dmax)/minimum density (Dmin), i.e., that a necessary Dmax is obtained and Dmin is restrained low.

For the purpose of accelerating the developing rate, there have been proposed those methods to increase pH of a processing liquid, to make a processing at a high temperature, to incorporate into a photographic emulsion or into a developer liquid a quaternary salt, a polyethylene glycol, a thioether compound, an amine (as described in U.S. Pat. Nos. 2,196,037, 2,496,903, 2,515,147 and 2,482,546), and the like. However, these methods, although effective to accelerate the developing rate to a certain extent, are not considered satisfactory due to the fact that the increase in fog, i.e., the deterioration of Dmax/Dmin, and the deterioration of graininess are observed in these methods.

On the other hand, it is known that the development, for the purpose of obtaining satisfactory Dmax/Dmin, is performed in the presence of such a development restrainer as potassium bromide, an azole, an azaindene, or the like, to distinct the areas to be developed from others. However, the use of these development restrainers also at the same time restrain somewhat areas that should be developed, so that they are considered to have undesirable effects from the rapid development point of view.

As mentioned above, the effect in the reciprocal relation between the method of rapid development and the method for obtaining satisfactory Dmax/Dmin by restraining fog low has been unavoidable. Therefore, any method capable of satisfying concurrently both rapid development that is desired in the color developing process and satisfactory Dmax/Dmin has still not been provided. Most of these conventionally conducted color developing processes are mainly intended for retaining satisfactory Dmax/Dmin, and the rapid development has not been attained unfortunately in these processes.

On the other hand, with respect to silver halide, a high-chloride silver halide, since it is highly soluble as compared to silver bromide and silver iodide, is considered able to cause the development to be carried out in a short period of time. However, a method which uses a high-chloride silver halide for the rapid and stable formation of a dye image has still not been made a practical.

This is due to the fact that although a high-chloride silver halide light-sensitive color photographic material has the possibility of applying to rapid development, no technique has been found to restrain fog alone with retaining the rapidity of development.

Generally speaking, as restrainers which may be added to a color developing bath, potassium bromide, tetrazaindene derivatives, mercaptotetrazoles, and the like, are well known. However, the processing of a high-chloride silver halide light-sensitive color photographic material in color developing bath containing one of these restrainers has may such disadvantages, for example, that potassium bromide not only has little fog-restraining effect during the processing of a high-chloride silver halide light-sensitive color photographic material but also reduces the rapidity of the processing; tetrazaindene derivatives cannot be hoped at all for any development-restraining effect; and mercaptotetrazoles, if in a small quantity, exert only a slight fog-restraining effect, and, if increased to a large quantity, restrain also the area that is desired to be developed, and, besides, significantly impair the function of the bleach-fixing process which follows the development process, the bleach-fixing process being a process for removing the silver produced by the development from the light-sensitive material in such a manner that the silver is caused by an oxidizing agent to become a silver halide which is then dissolved to be removed by a silver-halide solvent, so that the developed silver still remains in the formed dye image, thus deteriorating the dye image.

It is a first object of the present invention to provide a method for the formation of a dye image which uses a high-chloride silver halide to restrain fog low in a rapid developing process.

It is a second object of the present invention to provide a method for the formation of a dye image having an excellent color reproducibility.

It is a third object of the present invention to provide a method for the formation of a dye image, which has an excellent processing stability.

It is a fourth object of the present invention to provide a method for the formation of a dye image, which is capable of giving photographic characteristics stable against the deteriorative change in the developer liquid.

Another object of the present invention will be clarified by the following descriptions.

The above-described objects of the present invention is accomplished by a method for the formation of a dye image comprising a processing, after the imagewise exposure, of a silver halide light-sensitive color photographic material having on a support thereof a silver halide emulsion layer containing silver halide crystals having not less than 80 mol% of silver chloride, in a developer essentially free from bromide ion and having the pH value of not less than 9.5, in the presence of a p-phenylenediamine color developing agent and a compound having an acid dissociation constant of not more than $1\times10^{-8}$, a solubility product with silver ion of not more than $1\times10^{-10}$ and the next formula (I)

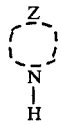

wherein Z represents a group of forming a heterocyclic ring.

In the present invention, if a compound has the above-mentioned characteristic values, any arbitrary heterocyclic ring may be selected as Z, but those most preferred include benzimidazole ring, benzotriazole ring, purine ring, 8-azapurine ring, and pyrazolopyrimidine ring.

In the present invention, if a compound has physical properties of an acid dissociation constant of not more than $1\times10^{-8}$ and a solubility product with silver of not more than $1\times10^{-10}$ and is represented by Formula (I) (the compound is hereinafter referred to as the compound of the present invention), it may be effectively used, and the preferred acid dissociation constant range is from $1\times10^{-8}$ to $1\times10^{-13}$.

Namely, in the present invention, a silver halide light-sensitive color photographic material having a high-chloride silver halide-containing layer is exposed imagewise and then processed in a developer liquid which is substantially free of bromine ion and the pH of which is not less than 9.5 in the presence of at least one of the restrainers of the present invention and of a p-phenylenediamine developing agent, whereby a fog-restrained, rapid and stable development is carried out, and further a dye image excellent in the color reproducibility is obtained.

The following are typical examples of the restrainers of the present invention, but the present invention is not limited thereto.

S-1

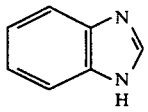

S-2

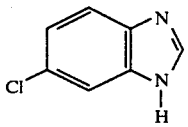

S-3

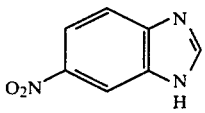

S-4

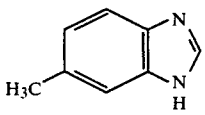

S-5

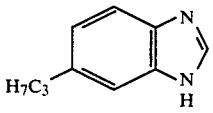

S-6

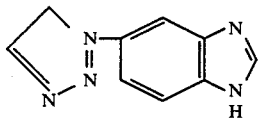

S-7

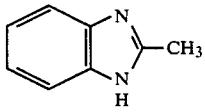

S-8

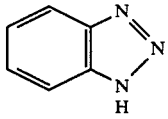

S-9

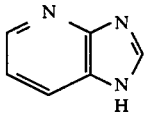

S-10

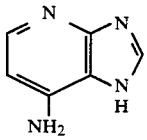

S-11 S-12

-continued

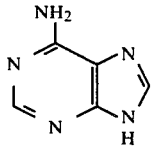

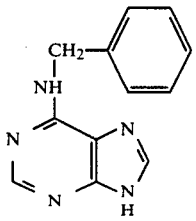

S-13

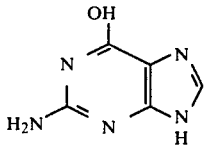

S-14

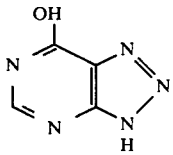

S-15

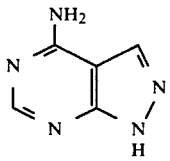

Synthesis methods of these compounds are well-known, so that those skilled in the art can readily synthesize these compounds. For the synthesis of these compounds, for example, the "Shin Jikken Kagaku Koza (New Course of Experimental Chemistry)" vol. 14 (published by Maruzen Co., Ltd.) may be consulted.

In the case where a restrainer of the present invention is used by being incorporated into a developer liquid, an adding quantity of the restrainer, although different according to the kind of it, may be from 0.5 mg to 50 g, and most preferably from 1 mg to 10 g per liter of a developer. And the restrainer of the present invention is also allowed to be added to the emulsion layer, interlayer and protective layer of a silver halide color photographic light-sensitive material, and in this case, may be used in a quantity of from 0.1 mg to 10 g, and preferably from 0.2 mg to 2 g per gram of silver. Thus, the restrainer of the present invention may be added to either a developer or a light-sensitive color photographic material, but in order to make the most of the effect, it is desirable to add the restrainer to the developer.

G. P. Faerman; J. Phot Sci (Journal of Photographic Science), 15 22 (1967), and the like, describe that, generally, development-restraining compounds function most effectively in the condition of being dissociated. However, according to our study, even if a compound is one that is included in those having Formula (I), if it has an acid dissociation constant of exceeding $1\times10^{-8}$, the effect of the compound, although the compound is dissociated under the development condition, is not recognized at all or, if any, is recognized to be only slight. The acid dissociation constant value is what was measured at a normal temperature, and is described in, e.g., the annex vol. 2 to the "Dai Yuki-Kagaku (Complete Organic Chemistry)" (published by Asakura Publishing Co., Ltd.), "The Theory of Photographic Process" written by T. H. James, 4th ed. (Published by McMillan), and the like. For the measurement of the acid dissociation constant there are several methods, and reference may be made to, e.g., the "Jikken Kagaku Koza (Course of Experimental Chemistry)" vol. 11, second series, (published by Maruzen Co., Ltd.) pp. 524 to 552, and the like.

Besides, the solubility product with silver ion of the restrainer of the present invention is no more than $1\times10^{-10}$. In the case of a compound having a solubility product of exceeding this level, i.e., a compound whose precipitation fruency with silver ion becomes smaller, any desired effect can not be expected. For the measurement and calculation of the solubility product, reference may be made to the "Shin Jikken Kagaku Koza," vol. 1 (published by Maruzen Co., Ltd.), pp. 233 to 250.

The restrainer of the present invention, even when used singly, exerts the sufficient effect thereof, but in order to further the effect, it is desirable the restrainer to be present together with chloride ion. During the development chloride ion is dissolved out of the silver halide light-sensitive color photographic material into the color developer liquid. It is desirable that chloride ion, including the dissolved chloride ion, to be present in a quantity of from $1\times10^{-3}$ mole to 0.5 mole, and most preferably from $2\times10^{-3}$ mole to 0.2 mole per liter of the color developer liquid of the present invention.

As p-phenylenediamine color developing agents applicable to the present invention, arbitrary ones may be used, but those preferred p-phenylenediamine color developing agents include 4-amino-N,N-diethyl-aniline hydrochloride, 4-amino-3-methyl-N,N-diethyl-aniline hydrochloride, 4-amino-3-methyl-N-ethyl-N-(β-methane-sulfonamido)ethyl-aniline sulfate-hydrate, 4-amino-3-methyl-N-ethyl-N-β-hydroxyethyl-aniline sulfate, 4-amino-3-β-(methane-sulfonamido)ethyl-N-N-diethyl-aniline hydrochloride, and 4-amino-N-ethyl-N-(2-methoxyethyl)-m-toluidinedi-P-toluene sulfonate. For those useful other than the above, reference may be made to J. Am. Chem. Soc (Journal of American Chemical Society) 73 3100 (1951) by Bent et al. and "The Theory of Photographic Process" by T. H. James, 4th ed. (McMillian) p. 315 to 320. In order to use a p-phenylene color developing agent by incorporating into the developer, the agent is desirable to be added in a quantity of from 0.1 g to 100 g, and more preferably from 0.5 to 20 g per liter of the developer. In addition, a p-phenylene color developing agent is also allowed to be incorporated into the silver halide light-sensitive color photographic material, and it may be used in a quantity of from 0.1 mole to 10 moles, and preferably from 0.5 mole to 5 moles per mole of a coupler that is used in the material. In incorporating the agent, the agent may be used, as it is, or in the form of a salt of an inorganic acid (such as hydrochloric acid, sulfuric acid, phosphoric acid, boric acid, nitric acid, or the like), of a salt of an organic acid or of a derivative thereof (such as, e.g. sulfonic acid, carboxylic acid, sulfamic acid, sulfinic acid, hydroxamic acid, polymer-sulfonic acid, a phosphoric acid ester, a sulfuric acid ester, a thiosulfuric acid ester, or the like), or of a salt of a metallic complex (such as, e.g., of nickel, zinc, lead, cobalt, copper, or the like), or further in the form of a precursor (such as, e.g., a Schiff base, an imido compound, an urethane compound, or the like).

The developer of the present invention is desirable to have a pH value of not less than 9.5, and preferably the pH value between not less than 10 and not more than 13. Conventionally, it has been well known that a development can be accelerated by increasing the pH of a developer, and when processed in a high-pH developer (pH > 12), particularly in a color development, although the development is recognized to be accelerated, an increase in fog and deterioration of graininess occur, thus leading to the deterioration of photographic characteristics. In the present invention, if the developer has a pH of not less than 9.5, the developer enables a rapid development without deteriorating photographic characteristics.

On the other hand, if the pH of the developer is less than 9.5, it is naturally disadvantageous for rapid development, and besides, fog becomes increasing in the pH range of less than 9.5, so that it is undesirable.

In the practice of the present invention, it is essential to use a developer which is substantially free of bromide ion because the presence of bromide ion significantly impairs the rapidity of development. The "developer substantially free of bromide ion" means a developer that contains bromide ion in only a quantity of not more than $1\times10^{-3}$. The present invention uses, as a silver halide, a high-chloride silver halide, and the high-chloride silver halide is desirable to be pure silver chloride. However, the high-chloride silver halide is allowed to contain partly silver bromide and silver iodide aside from silver chloride. Therefore, in the case of containing silver bromide, a slight amount of bromine ion is dissolved out into the developer during the development. The bromide ion which has been dissolved out into the developer is considered also to be partly substituted, due to the several orders of difference in the solubility to silver between bromide ion and chloride ion, with the chloride ion inside the area other than the image area, i.e., inside the high-chloride silver halide that is not developed even in the developer liquid, thereby to be retained inside the silver halide light-sensitive color photographic material to be carried out into the subsequent process. However, as has been described above, as long as bromide ion, even though in only a slight amount, is dissolved into the developer by developing the high-chloride silver halide, it is impossible to retain completely the bromide ion concentration to nothing in the developer. The meaning in the present invention of the "substantially free of bromide ion" is that there is contained no bromide ion with the exception of the bromide ion that is dissolved out and inevitably mixed into the developer, and the $1\times10^{-3}$ M is the upper limit of the inevitably mixed-in bromide ion concentration.

In the present invention, the development takes place at a temperature between 10° C. and 70° C., and preferably between 20° C. and 50° C.

The developer used in the present invention may contain other known developer component compounds, e.g., such alkali agents or buffer for the developer of the present invention as sodium hydroxide, ammonium hydroxide, sodium carbonate, sodium sulfate, sodium sulfite, sodium tertiary phosphate, potassium metaborate, borax, and the like, which may be used singly or in combination. And for the purpose of providing the developer with buffering ability or for the convenience of the preparation thereof, there may be further used such various salts as disodium or dipotassium hydrogen phosphate, sodium or potassium dihydrogen phosphate, sodium or potassium hydrogencarbonate, boric acid, alkali nitrates, and the like.

To the developer used in the present invention, if necessary, may be further added an arbitrary accelerating agent which includes pyridinium compounds or other cationic compounds, such neutral salts as thallium nitrate, potassium nitrate, etc., polyethylene glycol or derivatives thereof, organic amines, ethanolamine, ethylenediamine, diethanolamine, benzyl alcohol, phenylethyl alcohol, and the like.

Further, polyphosphoric acid compounds, aminopolycarboxylic acids, etc., may be used as water softeners, and, besides, calcium- and magnesium-hiding agents may be used in the developer.

An organic solvent may, if necessary, be incorporated into the developer in order to increase the solubility of those components of the developer, which solvent includes ethylene glycol, hexylene glycol, diethylene glycol, methyl Cellosolve, methanol, ethanol, acetone, triethylene glycol, dimethyl formamide, dimethyl sulfoxide, and the like.

After the formation of a dye image in accordance with the present invention, in order to remove the remaining image silver, the image silver is rehalogenated, if necessary, in a bleaching bath containing, e.g., red prussiate, aminocarboxylic acid ferric salt, etc., and subsequently fixed in a fixing bath containing a silver-halide solvent (such as, e.g., a thiosulfate, thiourea, ethylene-thiourea, a thiocyanate, a sulfur-containing diol, a sulfur containing dibasic acid, or the like). Alternatively, both bleaching and fixing are permitted to be made in a single bath.

The silver halide crystals to be used in the present invention are silver halide crystals that comprise silver chloride in a quantity of not less than 80 mole%, preferably not less than 90 mole%, and more preferably the silver halide should be pure silver chloride. The other silver halide is mostly silver bromide, or may of course be all silver bromide. Silver iodide may be incorporated depending on purposes, but the silver iodide, if used, should be in a quantity of up to 5 mole% at the most, and preferably up to 2 mole%.

These silver halides may be prepared in known manners. For example, the silver halide used in the present invention may be prepared in a manner selected, according to the kind or uses of a light-sensitive color photographic material, from among those for the so-called core-shell emulsion, conversion emulsion, epitaxial-junction emulsion, or for those preliminarily optically or chemically fogged emulsions. The size of the silver halide crystals used in the present invention is acceptable if within the normally used range. The crystal size distribution may be of either polydispersed system or monodispersed system, but the emulsion is more desirable to be a monodispersed system emulsion. And these emulsions may be chemically sensitized by the single or arbitrarily combined use of active gelatin; sulfur sensitizers such as, e.g., allylthiocarbamide, thiourea, thiosulfates, cystine, and the like; selenium sensitizers; reduction sensitizers such as, e.g., stannous salts, polyamines, and the like; noble-metallic sensitizers such as, e.g., gold sensitizers including potassium aurithiocyanate, potassium chloroaurate, 2-aurosulfobenzothiazole-metachloride, etc., or e.g., water-soluble-salt sensitizers such as salts of ruthenium, rhodium, iridium, etc., and more concrete examples including ammonium chloropalladate, potassium chloroplatinate, sodium chloropalladate (some of these function as either sensitizers or fogging agent, depending upon quantities thereof to be used), the combined use being such as, e.g., a gold sensitizer with a sulfur sensitizer, a gold sensitizer with a selenium sensitizer, and the like.

Further, the silver halide may be optically sensitized to desired wavelength regions by the single or combined use of such spectral sensitizers as cyanine dyes including, e.g., zero-methine dye, monomethine dye, dimethine dye, trimethine dye, and the like; or merocyanine dyes, and the like.

The high-chloride silver halide applicable to the present invention hardly absorves visible rays. Accordingly, the optically green-sensitized or red-sensitized high chloride silver halide emulsion is hardly sensitive to blue light. This nature is capable of improving largely the color reproducibility of the light-sensitive photographic material.

Most of those conventional silver halide emulsions consisting principally of silver bromide used in silver halide light-sensitive color photographic materials, if subjected to optical green-sensitization or red-sensitization, also are sensitive to blue light because the silver bromide itself contained therein is sensitive to blue light in addition to the desired spectral sensitivity. For this reason, when exposed to blue light, it was unavoidable that not only the blue-sensitive emulsion but also the green-sensitive and red-sensitive emulsions become sensitive to the light.

In a silver halide light-sensitive color photographic material, the respective red-sensitive, green-sensitive and blue-sensitive emulsions are usually coated as separate layers in combination with different couplers, respectively, the couplers forming different dyes during the color developing process (for example, aside from those specially used in the aerial photography, the generally used combination is such as the red-sensitive emulsion with a cyan dye-forming coupler, green-sensitive emulsion with a magenta dye-forming coupler, and blue-sensitive emulsion with a yellow dye-forming coupler). Therefore, in a silver halide light-sensitive color photographic material consisting principally of silver bromide, after the light-sensitive material is exposed to blue light and when subjected to a color development, in addition to the dye produced by the reaction of the developing agent with the coupler in combination with the blue-sensitive emulsion, different dyes are also partly formed from the couplers in combination with the red-sensitive emulsion and the green-sensitive emulsion, thereby producing a turbidity in the light-sensitive material. Namely, at the time of the exposure, the cause of the turbidity had already been produced, whereby the color reproducibility becomes deteriorated. Various attempts have been made to prevent such the deterioration of the color reproducibility. For example, an yellow filter dye layer or a colloidal silver layer is provided to reduce the blue-sensitivities of the red-sensitive emulsion and the green-sensitive emulsion; a silver halide having a large-size silver halide particles is used as the blue-sensitive emulsion to thereby make a large difference between the blue-sensitivity of the blue-sensitive emulsion and the blue-sensitivities of the red-sensitive and green-sensitive emulsions; and so forth;—such methods have been attempted. These methods, however, were still incomplete as means to improve the color reproducibility despite many such sacrifices as the deterioration of the blue-sensitivity leading to an increase in the consumption of silver, an increase in fog, the deterioration of the developing rate, and like. In contrast to this, in the present invention, since a high-chloride silver halide is used as a silver halide, the blue-sensitivities of the red-sensitive and green-sensitive emulsions are nearly negligible, so that the present invention is capable of providing an essentially improving means to the cause of the turbidity that occurs at the time of exposure.

And the silver halide is dispersed into an appropriate protective colloid to thereby compose a light-sensitive layer. As the protective colloid for use in light-sensitive layers or other layers (component elements such as interlayers, a protective layer, filter layers, etc.), gelatin is generally used, but there are gelatin derivatives, colloidal albumin, cellulose derivatives, such synthetic resins as polyvinyl compounds, and the like, and these are allowed to be used singly or in combination, and, in addition, may also be used in combination with an acetyl cellulose whose acetyl content is from 19 to 26%, a water-soluble ethanolamine, a cellulose acetate, and the like.

As couplers for use in the present invention, all those known couplers may be used, which may be incorporated into either a developer or the silver halide emulsion. Yellow couplers usable in the present invention include benzoyl acetanilide compounds, pivaloylacetanilide compounds, and the like; magenta couplers include 5-pyrazolone compounds, pyrazolotriazole compounds, pyrazolinobenzimidazole compounds, indazolone compounds, cyanoacetyl compounds, and the like; and cyan couplers include phenol compounds, diacylaminophenol compounds, naphthol compounds, and the like. These couplers may be of either the so-called two-equivalent type or four-equivalent type. And these couplers may also have a fluorine-containing substituent intended to adjust the hue of the dye formed by the reaction with the oxide of an aromatic primary amine compound of the present invention. Furthermore, in combination with these couplers, there may be used azo-type colored couplers intended to be used for automasking, osazone type compounds, development diffusible dye releasing type couplers, and the like. In that case, it is desirable to use the so-called colorless coupler that is colorless before being subjected to a color development together with the above-mentioned masking coupler. Besides, in order to improve photographic characteristics, competing couplers, DIR couplers, BAR (Bleach Accelerator Releasing) couplers may also be incorporated.

Silver halide emulsions containing such photographic couplers and the like prepared as described in above are coated on a support at need together with a subbing layer, interlayers, filter layers, an anticurl layer and a protective layer, whereby a silver halide light-sensitive photographic material for use in the present invention may be prepared. Materials for the support applicable to the above light-sensitive photographic material include paper, laminated paper (such as, e.g., polyethylene-laminated paper), glass, and film- or sheet-formed cellulose acetate, cellulose nitrate, polyester, polycarbonate, polyamide, polystyrene, polyolefin, and the like. And these support materials, for the purpose of improving the adhesion thereof to layers, may be subjected to a surface treatment such as various hydrophilic treatments, e.g., saponification treatment, corona discharge treatment, subbing treatment, setting treatment, and the like.

The light-sensitive photographic material of the present invention may also contain in the light-sensitive layers and/or other layers thereof (such as interlayers, subbing layer, filter layers, protective layer, image-receiving layers, and the like), according to purposes, various photographic additives which include stabilizers such as, e.g., mercury compounds, triazoles, azaindenes, quaternary benzothiazolium, zinc or cadmium salts, and the like; sensitizers such as quaternary ammonium salts, polyethylene glycols, and the like; layer's physical characteristics-improving agents such as, e.g., glycerol, dihydroxyalkanes such as 1,5-pentadiol, ethylene-bis-glycolic acid esters, bisethoxydiethylene glycol succinate, acrylic acid amide, emulsion of polymers, and the like; hardening agents such as, e.g., formaldehyde, halogen-substituted fatty acids such as mucochloric acid, mucobromic acid, etc., acid anhydride radical-having compounds, dicarboxylic acid chloride, disulfonic acid chloride, methane-sulfonic acid biester, sodium hydrogensulfite derivatives of dialdehyde wherein the aldehyde radicals are separated by 2 or 3 carbon atoms, bisaziridine, ethyleneimine, and the like; coating aids such as, e.g., saponin, lauryl or oleyl monoether of polyethylene glycol, sulfated or alkylated polyethylene glycol salts, and the like; coating assistants such as, e.g., sulfosuccinates, and the like; organic solvents such as coupler solvents including high boiling solvents and/or low boiling solvents such as, e.g., dibutyl phthalate, tricresyl phosphate, acetone, methanol, ethanol, ethylene Cellosolve, and the like; DIR compounds which release development inhibitors during color development and produce substantially colorless compounds; antistatic agents, defoaming agents, ultraviolet absorbing agents, brightening agents, antislipping agents; matting agents, antihalation or antiiradiation agents; and the like, and these various additives may be used singly or in combination.

The present invention is illustrated in further detail with reference to examples below, but the embodiments of the present invention are not limited thereto.

EXAMPLE 1

The following layers were coated on a resin-coated paper support to thereby prepare a silver halide light-sensitive color photographic material sample.

In all the examples which will be described hereinafter, all various compounds to be added to the silver halide light-sensitive color photographic material, unless otherwise noticed, are to be indicated in quantities per 100 $cm^2$.

A silver halide light-sensitive material layer having 4.0 mg of magenta coupler A, a green-sensitive silver chloride emulsion (average crystal size 0.6μ, silver equivalent of 3.5 mg) and 20 mg of gelatin.

On this layer was coated and dried a gelatin protective layer containing 10 mg of gelatin. The thus obtained sample was regarded as (I). The resulting sample (I) was exposed through an optical wedge and then processed as follows:

| Processing steps: | | |
|---|---|---|
| Color development | at 33° C. | 30 seconds |
| Bleach-fixing | at 30° C. | 1 minute and 30 seconds |
| Washing | at 30° C. | 2 minutes |

Compositions of the processing liquids:

Color developer:

| | |
|---|---|
| Pure water | 800 ml |
| Ethylene glycol | 12 ml |
| Benzyl alcohol | 12 ml |
| Anhydrous potassium carbonate | 30 g |
| Anhydrous potassium sulfite | 2.0 g |
| N—ethyl-N—(β-methane-sulfonamide)-ethyl-3-methyl-4-aminoaniline sulfate | 4.5 g |
| Add pure water to make 1 liter | |

Potassium hydroxide or sulfuric acid is used to adjust the pH to 10.7

To the above-prepared developer was added each of the compounds as given in Table 1 to thereby prepare color developers [A] to [M]. The acid dissociation constants (Ka) and the solubility products with silver ion (Ksp) of the added compounds are also given in Table 1.

TABLE 1

| Color developer | Compound added | | Ka | Ksp |
|---|---|---|---|---|
| [A] | — | | — | — |
| [B] | Sodium chloride | 1.0 g/l | — | — |
| [C] | Exemplified compound S-1 | 0.1 g/l | $2 \times 10^{-12}$ | $3.2 \times 10^{-12}$ |
| [D] | Exemplified compound S-5 | 0.02 g/l | $4.9 \times 10^{-11}$ | $6.3 \times 10^{-13}$ |
| [E] | Exemplified compound S-8 | 0.1 g/l | $5.0 \times 10^{-9}$ | $4.0 \times 10^{-14}$ |
| [F] | Exemplified compound S-11 | 0.03 g/l | $1.6 \times 10^{-10}$ | $3.2 \times 10^{-13}$ |
| [G] | Comparative compound (1) | 1.0 g/l | $6.3 \times 10^{-8}$ | |
| [H] | Comparative compound (2) | 1.0 g/l | $3.2 \times 10^{-7}$ | $3.2 \times 10^{-11}$ |
| [I] | Comparative compound (3) | 0.1 g/l | $4.6 \times 10^{-4}$ | $6.3 \times 10^{-17}$ |
| [J] | Exemplified compound + Sodium chloride S-1 | 0.1 g/l<br>1.0 g/l | | |
| [K] | Exemplified compound + Sodium chloride S-3 | 0.02 g/l<br>1.0 g/l | | |
| [L] | Exemplified compound + Sodium chloride S-8 | 0.02 g/l<br>1.0 g/l | | |
| [M] | Exemplified compound + Sodium chloride S-11 | 0.02 g/l<br>1.0 g/l<br>1.0 g/l | | |

Comparative compound (1): Imidazole
Comparative compound (2): 4-hydroxy-6-methyl-1,3,3a,7-tetrazaindene
Comparative compound (3): 1-phenyl-5-mercaptotetrazole Bleach-fixer:

| | |
|---|---|
| Ammonium thiosulfate | 100 g |
| Potassium sulfite | 5 g |
| Na[Fe(EDTA)] | 40 g |
| EDTA | 4 g |
| Water to make 1 liter | |

The obtained sample was subjected sensitometry, and the results of the obtained dye image densities are shown in Table 2.

TABLE 2

| Color developer | | Density Dmax | Density Dmin |
|---|---|---|---|
| [A] | | 2.88 | 2.05 |
| [B] | | 2.81 | 1.90 |
| [C] | (Developer of the invention) | 2.80 | 0.11 |
| [D] | " | 2.86 | 0.09 |
| [E] | " | 2.85 | 0.13 |
| [F] | " | 2.79 | 0.10 |
| [G] | (Comparative developer) | 2.74 | 1.28 |
| [H] | " | 2.77 | 1.10 |
| [I] | " | 1.10 | 0.06 |
| [J] | (Developer of the invention) | 2.76 | 0.02 |
| [K] | " | 2.77 | 0.02 |
| [L] | " | 2.75 | 0.03 |
| [M] | " | 2.80 | 0.02 |

As apparent from Table 2, it is understood that the rapid development can be carried out without diteriorating Dmax and with significantly restraining Dmin by processing a high-chloride silver halide emulsion in a developer containing the restrainer of the present invention. In contrast to this, comparative compound (1) which is one that is generally known as a restrainer for a color developer but not included in the restrainers of the present invention has only a little effect to lower Dmin, so that it cannot be practically used. On the other hand, comparative compound (3), when added in the quantity as in this example, lowers not only Dmin but also Dmax, and, when added in a small quantity than in this example, has no sufficient effect to lower Dmin.

And chlorine ion that is said to have an antifogging effect upon a silver chloride emulsion, as described in "The Theory of Photographic Process" 4th ed. by T. H. James, p. 396 (McMillan), has little effect in itself to lower Dmin, but, when used together with the restrainer of the present invention, exerts a synergistic effect to increase the restraining of Dmin, and yet does not retard the developing rate. Thus, the presence of chlorine ion together with the restrainer of the present invention enables the restraining effect of the invention to be more excellent.

EXAMPLE 2

The following layers were coated on a resin-coated paper support to thereby prepare a silver halide light-sensitive color photographic material sample.

A light-sensitive silver halide emulsion having 4.0 mg of magenta coupler A, a green-sensitive chlorobromide emulsion (containing 80 mole% silver bromide, average crystal size 0.6μ, silver equivalent of 3.5 mg) and 20 mg of gelatin.

On this was coated and dried a gelatin protective layer containing 10 mg of gelatin. The resulting material was regarded as sample (II).

The thus obtained sample (II) and sample (I) prepared in Example 1 were exposed through an optical wedge and then processed as follows:

| Processing steps: | | |
|---|---|---|
| Color development | at 33° C. | |
| Bleach-fixing | at 30° C. | 1 minute and 30 seconds |
| Washing | at 30° C. | 2 minutes |

Compositions of the processing liquids:

Color developer:

Color developers [L] and [M] used in Example 1 and color developer [N] obtained by adding potassium bromide in the quantity of 0.7 g/liter to color developer [B] also used in Example 1 were prepared.

For bleach-fixing, the same bleach-fixer as used in Example 1 was used. The dye image densities of the samples obtained when the samples were subjected to color development for three minutes are as shown in Table 3. And the changes in the sensitometric curves according to the changes obtained when processing sample (I) in color developers [M] and [N] and when processing sample (II) in color developer [N] are shown in FIG. 1.

TABLE 3

| Sample | | Color developer | | Dmax | Dmin |
|---|---|---|---|---|---|
| (II) | Comparative sample | [L] | (Invention) | 2.72 | 0.29 |
| | | [M] | " | 2.78 | 0.30 |
| | | [N] | (Comparative) | 2.74 | 0.03 |
| (I) | Sample of the invention | [L] | (Invention) | 2.80 | 0.04 |
| | | [M] | " | 2.84 | 0.02 |
| | | [N] | (Comparative) | 2.78 | 0.35 |

As apparent from Table 3, it is understood that when a chlorobromide emulsion which is composed principally of silver bromide and which has conventionally been used mostly as a light-sensitive color photographic material is processed in a color developer containing the restrainer of the present invention, Dmin of the emulsion becomes increased, so that no excellent image cannot be obtained, but by being processed in a color developer containing bromide ion generally known as a restrainer for color development, Dmin of the emulsion can be restrained low. However, in this case, as apparent from FIG. 1, the developing rate is slow, so that no rapid development can be attained.

And even when the high-chloride silver halide emulsion of the present invention is processed in a bromide ion-containing color developer, as seen from FIG. 1, the restraining of Dmin is insufficient and, besides, the developing rate is low. In contrast to this, however, when the high-chloride silver halide emulsion is processed in a color developer containing the restrainer of the present invention, Dmin is effectively restrained low, whereby an excellent dye image having a high Dmax can be obtained in a short-period development.

EXAMPLE 3

Sample (I) that was prepared in Example 1 was exposed through an optical wedge and then processed in accordance with the processing steps in Example 1 with the use of three developers of which the composition is the same as that in Example 1 but which have different pH values: 8.8, 10.2 and 11.8, respectively. As for development time, the sample was processed for one minute in the developers of pH 10.2 and pH 11.8, and also processed separately for one minute and three minutes in the developer of pH 8.8. The resulting sensitometric curves of the sample are as shown in FIG. 2.

As seen from FIG. 2, even if pH values of the developer are largely different, the sensitometric characteristics (fog, gradation, etc.) of the processed sample are hardly affected. In contrast, however, when processed in the developer of pH 8.8, the developing rate becomes reduced with the increase in fog, resulting in an extreme deterioration of the sensitometric characteristics. Thus, the method for the formation of a dye image of the present invention is found to be rapid and stable only when the development is made under the condition of a pH value of not less than 9.5.

EXAMPLE 4

Sample (1) prepared in Example 1 was exposed through an optical wedge and then processed in accordance with the processing steps in Example 1, provided that color developers [O] to [Q] prepared by adding bromine ion in the ion concentrations given in Table 4 to developer [M] were used.

The dye image densities obtained by processing the sample separately for periods of 15 seconds, 30 seconds and one minute in each of the above-prepared color developers are as indicated in Table 4.

TABLE 4

| Color developer | Bromine ion concentration | Dmax 15 sec | 30 sec | 1 min |
|---|---|---|---|---|
| [M] | 0 | 2.80 | 2.87 | 2.85 |
| [O] | $2 \times 10^{-3}$ mol/l | 0.15 | 0.86 | 2.15 |
| [P] | $5 \times 10^{-3}$ mol/l | 0.04 | 0.28 | 1.14 |
| [Q] | $5 \times 10^{-4}$ mol/l | 2.61 | 2.85 | 2.85 |

As apparent from Table 4, it is understood that the rapidity of the development becomes outstandingly retarded by bromine ion. However, as has been explained in the detailed description of the invention, in a very slight concentration of bromine ion (not more than $1 \times 10^{-3}$ mole/liter) that is likely to be dissolved out of the high-chloride silver halide during the development into the developer liquid, the rapidity of the development is not affected.

EXAMPLE 5

The following layers were coated in order on a resin-coated paper support to thereby prepare a silver halide light-sensitive color photographic material, which was regarded as sample (III):

(1) A blue-sensitive silver halide emulsion layer containing 7.8 mg of yellow coupler B, a blue-sensitive silver chloride (average crystal size 0.8μ, silver equivalent of 4.0 mg) and 20 mg of gelatin.
(2) An interlayer containing 0.2 mg of dioctyl hydroquinone and 10 mg of gelatin.
(3) A green-sensitive silver halide emulsion layer containing 4.2 mg of magenta coupler A, a green-sensitive silver chloride emulsion (average crystal size 0.5μ, silver equivalent of 3.7 mg) and 20 mg of gelatin.
(4) An interlayer containing 0.3 mg of dioctyl hydroquinone and 15 mg of gelatin.
(5) A red-sensitive silver halide emulsion layer containing 3.2 mg of cyan coupler C, a red-sensitive silver chloride emulsion (average crystal size 0.4μ, silver equivalent of 3.0 mg) and 15 mg of gelatin.
(6) A gelatin protective layer containing 10 mg of gelatin.

The thus obtained sample was regarded as sample (III).

Further, a comparative sample was prepared in accordance with the following manner:

A blue-sensitive silver chlorobromide emulsion (containing 80 mole% silver bromide, average crystal size 0.8μ, silver equivalent of 4.0 mg) was used in place of the blue-sensitive silver chloride emulsion in (1) of the above sample (III), a green-sensitive silver chlorobromide emulsion (containing 70 mole% silver bromide, average crystal size 0.5μ, silver equivalent of 3.7 mg) was used in place of the green-sensitive silver chloride emulsion in (3), and a red-sensitive silver chlorobromide emulsion (containing 70 mole% silver bromide, average crystal size 0.4μ, silver equivalent of 3.0 mg) was used in place of the red-sensitive silver chloride emulsion in (5). And the resulting sample was regarded as sample (IV).

Sample (III) and sample (IV) were exposed through an optical wedge and then processed as follows:

| Processing steps: | | |
|---|---|---|
| Color development | at 33° C. | — |
| Bleach-fixing | at 30° C. | 1 minute and 30 seconds |
| Washing | at 30° C. | 2 minutes |

Compositions of the processing liquids:

Color developers [R] and [S] were prepared by adding the compounds shown in Table 5 to color developer [B].

TABLE 5

| Color developer | Compound added | |
|---|---|---|
| [R] | Exemplified compound S-12 | 0.02 g/l |
| [S] | Exemplified compound S-13 | 0.1 g/l |

For bleach-fixing, the same bleach-fixer as in Example 1 was used. The dye image densities of these samples obtained by processing sample (III) in color developers [R] and [S] and by processing sample (IV) in color developer [N] are as shown in Table 6.

TABLE 6

| Sample | Color developer | Developing time | Density Red Dmax | Red Dmin | Green Dmax | Green Dmin | Blue Dmax | Blue Dmin |
|---|---|---|---|---|---|---|---|---|
| Sample (III) (Invention) | [R] Developer of the invention | 30 sec | 2.68 | 0.01 | 2.60 | 0.02 | 1.89 | 0.01 |
| | | 1 min | 2.70 | 0.03 | 2.81 | 0.03 | 2.32 | 0.02 |
| | | 3 min | 2.70 | 0.03 | 2.83 | 0.03 | 2.30 | 0.02 |
| | [S] Developer of the invention | 30 sec | 2.73 | 0.02 | 2.56 | 0.03 | 1.95 | 0.02 |
| | | 1 min | 2.69 | 0.03 | 2.81 | 0.03 | 2.28 | 0.02 |
| | | 3 min | 2.71 | 0.04 | 2.79 | 0.04 | 2.33 | 0.03 |
| Sample (IV) (Comparison) | [N] Comparative developer | 30 sec | 1.11 | 0.02 | 0.82 | 0.01 | 0.35 | 0.01 |
| | | 1 min | 1.90 | 0.02 | 1.75 | 0.02 | 0.98 | 0.02 |
| | | 3 min | 2.68 | 0.03 | 2.77 | 0.04 | 2.32 | 0.03 |

As apparent from Table 6, it is understood that, according to the present invention, even in the multi-layer sample wherein silver halide emulsion layers and the like are multi-layered, the formation of an excellent dye image with the Dmax increased and with the Dmin restrained low in a short developing period can be accomplished. In contrast to this, in the case where the light-sensitive color photographic materal which uses silver chlorobromide emulsions consisting principally of silver bromide and which is of the type that has been conventionally extensively used is processed in a bromine ion-containing developer of the type that has been generally used in ordinary color development, the rapidity of the development is extremely inferior to that of the present invention.

EXAMPLE 6

Sample (III) of the invention prepared in Example 5 and comparative sample (IV) were exposed through an optical wedge and the each processed in color developers which differ in pH as shown in Table 7. The processing of these samples was performed in accordance with the processing steps in Example 1, provided that sample (III) was processed for one minute, while comparative sample (IV) for three minutes because the developing speed thereof is low.

The obtained samples were subjected to sensitometry to obtain gamma values which are shown in Table 7. The gamma value indicated herein is the reciprocal of the difference between the logarithm of an exposure to give the dye density of 0.8 and the logarithm of an exposure to give the dye density of 1.8, and the larger the value that represents the gradation of an image, the higher does the contrast become.

TABLE 7

| Sample | Color developer | pH | Gamma value Red | Green | Blue |
|---|---|---|---|---|---|
| (III) Sample of the invention | [M] Developer of the invention | 10.0 | 4.55 | 4.44 | 4.29 |
| | | 10.4 | 4.61 | 4.56 | 4.36 |
| | | 10.8 | 4.70 | 4.60 | 4.43 |
| | | 11.2 | 4.58 | 4.58 | 4.30 |
| (IV) Comparative sample | [N] Comparative developer | 10.0 | 3.01 | 3.15 | 3.14 |
| | | 10.4 | 3.56 | 3.80 | 3.78 |
| | | 10.8 | 3.96 | 4.10 | 3.95 |
| | | 11.2 | 4.20 | 4.32 | 4.18 |

The sensitometric characteristics of an imagewise-exposed silver halide light-sensitive color photographic material, even if the material is processed in succession over an extensive period of time or processed on different occasions, must be stably retained. However, in those methods which have been conventionally practiced, there have been unavoidable changes in the sensitometric characteristics, particularly in the gradation. As the cause of this, several factors are conceivable, but one of the largest factors is said to be the change in the pH of a developer. Also in the examples of the present invention, in the method described as of comparison which has been conventionally extensively used, the gradation is found to be significantly changed by the change in the pH of the developer. For this reason, the control of the pH of developers presently requires much labor. In contrast, it is understood that the method of the present invention, even when the pH of the developer is changed, enables to obtain a stable gradation-having dye image. Consequently, the method of the present invention reduces largely the complexity of pH control.

EXAMPLE 7

The comparison between the color reproducibilities of the method of the present invention and of the comparative method which is of the conventional type was carried out in the following manner: A commercially available SAKURA Color Negative film was used to photograph a dark green landscape and then processed. Printings were made on sample (III) and sample (IV) from the processed negative film by means of a color printer. After the printing, sample (III) was processed in color developer [M] for one minute, while sample (IV) was processed in color developer [N] for three minutes. After that, both samples were bleach-fixed and washed in the same manner as in Example 1, whereby color prints of the image were obtained.

As the result, in the color print image obtained by the comparative method of the conventional type, turbidity in color was observed in the dark green, while in the color print image obtained by the method of the present invention, pure green was reproduced.

EXAMPLE 8

10 mg of a color developing agent precursor P-1 were added to each of the layers (2) and (4) of sample (III), which is the multi-layer silver chloride photographic light-sensitive material prepared in Example 5, whereby a sample (V) was prepared.

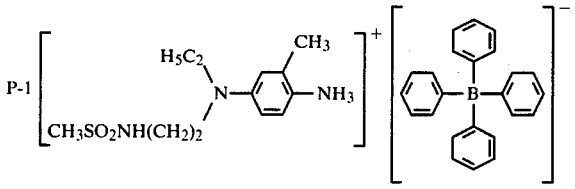

In addition, the method of incorporating P-1 into a light-sensitive material is detailed in Japanese Patent Publication Open to Public Inspection No. 6235/1981.

Sample (V) was exposed through an optical wedge and then processed as follows:

| Processing steps II: | | |
|---|---|---|
| Active development | at 40° C. | 30 seconds |
| Bleach-fixing | at 30° C. | 2 minutes |
| Washing | at 30° C. | 2 minutes |
| Composition of the activator: | | |
| Pure water | | 800 ml |
| Benzyl alcohol | | 12 ml |
| Anhydrous potassium carbonate | | 30 g |
| Anhydrous potassium sulfite | | 2.0 g |
| Sodium chloride | | 1.0 g |
| Add pure water to make 1 liter | | |
| Potassium hydroxide or sulfuric acid is used to adjust pH to 11.5 | | |

To the above composition-having activator was added each of the compounds given in Table 8 to thereby prepare activators [T] to [V].

TABLE 8

| Activator | Compound added | |
|---|---|---|
| [T] | Exemplified compound S-1 | 0.05 g/l |
| [U] | Exemplified compound S-11 | 0.02 g/l |
| [V] | Comparative compound (2) | 1 g/l |

The dye image densities of the obtained samples are as shown in Table 9.

TABLE 9

| | Density | | | | | |
|---|---|---|---|---|---|---|
| | Red | | Green | | Blue | |
| Activator | Dmax | Dmin | Dmax | Dmin | Dmax | Dmin |
| [T] (Invention | 2.74 | 0.06 | 2.80 | 0.07 | 2.40 | 0.05 |
| [U] (Invention | 2.63 | 0.05 | 2.70 | 0.08 | 2.38 | 0.04 |
| [V] (Comparison | 2.80 | 1.81 | 2.78 | 1.95 | 2.44 | 1.32 |

As apparent from Table 9, it is understood that the p-phenylenediamine type color developing agent-incorporated high-chloride silver halide color photographic light-sensitive material is processed in a color developing agent-free alkaline liquid (activator liquid) in the presence of the restrainer of the present invention, whereby an excellent dye image having a low Dmin and a high Dmax can be obtained.

Magenta coupler A

-continued

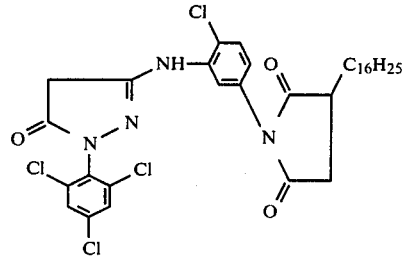

Yellow coupler B

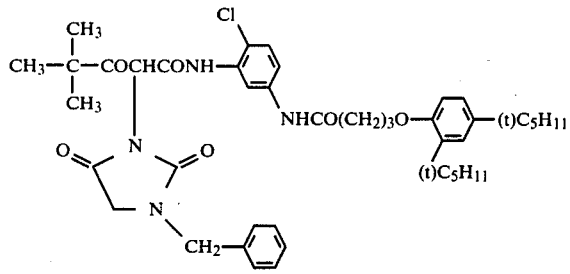

Cyan coupler C

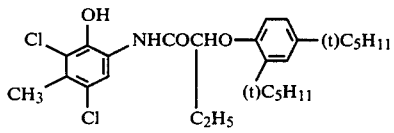

BRIEF DESCRIPTION OF THE DRAWINGS

FIG. 1(1) is a graph showing the change in the sensitometric curve of sample (I) according to the difference in the developing time when the sample is processed in color developer [M]. As for the developing time, 15 seconds for curve 1, 30 seconds for curve 2, one minute for curve 3, and three minutes for curve 4.

FIG. 1(2) is a graph showing the change in the sensitometric curve of sample (I) according to the difference in the developing time when the sample is processed in color developer [N]. As to the developing time, 15 seconds for curve 1, 30 seconds for curve 2, one minute for curve 3, and three minutes for curve 4.

FIG. 1(3) is a graph showing the change in the sensitometric curve of sample (II) according to the difference in the developing time when the sample is processed in color developer [N]. As to the developing time, 15 seconds for curve 1, 30 seconds for curve 2, one minute for curve 3, and three minutes for curve 4.

Figure 2:
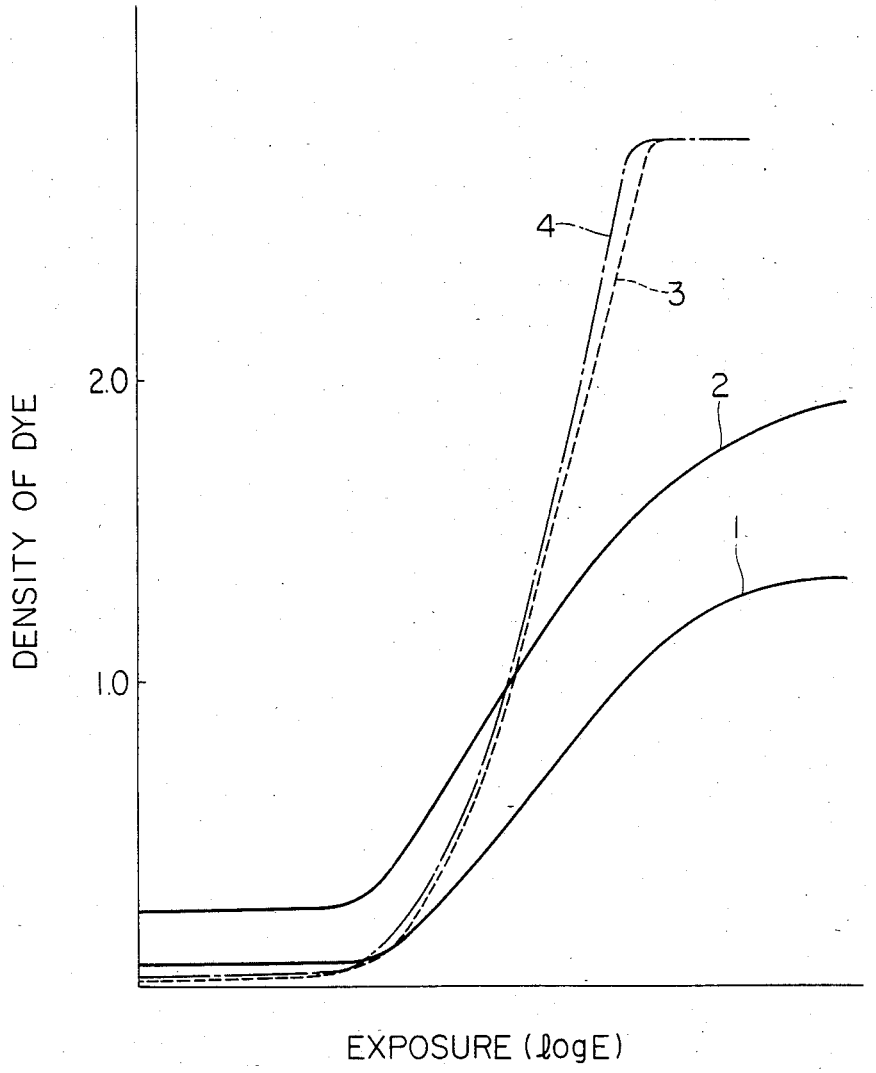
FIG. 2 is a graph showing the change in the sensitometric curve of sample (I) according to the difference in pH of color developer [M] in which the sample is processed. As to the pH change, pH 8.8 for curve 1 (developing time: one minute), pH 8.8 for curve 2 (developing time: three minutes), pH 10.2 for curve 3 (developing time: one minute), and pH 11.8 for curve 4 (developing time: one minute).

We claim:

1. A method for forming a dye image comprising imagewise exposing and developing a silver halide light-sensitive color photographic material having a support and coated thereon at least one silver halide emulsion layer, each of said layers containing at least 80 mole % silver chloride, said developing taking place in a developer essentially free from bromide ion and having a pH value of at least 9.5, in the presence of a p-phenylenediamine color-developing agent and a compound of the formula

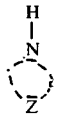

having an acid dissociation constant of not more than $1\times10^{-8}$ and a solubility produce with silver ion of not more than $1\times10^{-10}$, wherein Z, together with N, forms a heterocyclic ring.

2. A method for the formation of a dye image according to claim 1 wherein said heterocyclic ring is selected from the group consisting of benzimidazole ring, benzotriazole ring, purine ring, 8-azapurine ring and pyrazolo pyrimidine ring.

3. A method for the formation of a dye image according to claim 1 wherein said compound is added to the developer.

4. A method for the formation of a dye image according to claim 3 wherein the adding quantity of said compound is from 1 mg to 10 g per liter of the developer.

5. A method for the formation of a dye image according to claim 1 wherein the pH value is from 10 to 13.

6. A method for the formation of a dye image according to claim 1 wherein said layer is pure silver chloride.

7. A method for the formation of a dye image according to claim 1 wherein chloride ions are present in a quantity of from $2\times10^{-3}$ to 0.2 mole per liter of the developer.

8. A method for the formation of a dye image according to claim 2 wherein said compound is added to the developer.

9. A method for the formation of a dye image according to claim 8 wherein the adding quantity of said compoound is from 1 mg to 10 g per liter of the developer.

10. The method of claim 1 wherein said layer contains at least 90 mole % silver chloride.

11. A method for the formation of a dye image according to claim 1 wherein silver halide crystals in said layer have a mono dispersed crystal size distribution.

* * * * *